US012703892B2

(12) United States Patent
Bhaduri et al.

(10) Patent No.: US 12,703,892 B2
(45) Date of Patent: Aug. 11, 2026

(54) METALS RECOVERY FROM SPENT CATALYST

(71) Applicant: Chevron U.S.A. Inc., San Ramon, CA (US)

(72) Inventors: Rahul Shankar Bhaduri, Moraga, CA (US); Bruce Edward Reynolds, Martinez, CA (US); Oleg A. Mironov, Hercules, CA (US); Alexander Kuperman, Orinda, CA (US); Woodrow K. Shiflett, Richmond, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 935 days.

(21) Appl. No.: 17/625,444

(22) PCT Filed: Jul. 8, 2020

(86) PCT No.: PCT/IB2020/056420

§ 371 (c)(1),
(2) Date: Jan. 7, 2022

(87) PCT Pub. No.: WO2021/005526

PCT Pub. Date: Jan. 14, 2021

(65) Prior Publication Data

US 2022/0259696 A1 Aug. 18, 2022

Related U.S. Application Data

(60) Provisional application No. 62/963,222, filed on Jan. 20, 2020, provisional application No. 62/871,258, filed on Jul. 8, 2019.

(51) Int. Cl.

| | |
|---|---|
| ***C22B 7/00*** | (2006.01) |
| ***C22B 34/22*** | (2006.01) |
| ***C22B 34/34*** | (2006.01) |

(52) U.S. Cl.
CPC ..... *C22B 7/009* (2013.01); *C22B 7/008* (2013.01); *C22B 34/225* (2013.01); *C22B 34/345* (2013.01)

(58) Field of Classification Search
CPC ..... C22B 7/009; C22B 7/008; C22B 34/225; C22B 34/345
See application file for complete search history.

(56) References Cited

U.S. PATENT DOCUMENTS 4,087,510 A * 5/1978 Steenken ..... C22B 1/02 423/119
4,430,442 A 2/1984 Sawyer
(Continued)

FOREIGN PATENT DOCUMENTS

CN 101435027 B 6/2010
CN 101918132 A 12/2010
(Continued)

OTHER PUBLICATIONS

Kar et al., "Recovery of molybdenum from spent hydro-refining catalysts by soda ash roasting", Eur. J. Mineral Proc. Envir. Pro., v5, No. 1, 1303-0868, 2005, pp. 100-104.
(Continued)

*Primary Examiner* — Anthony J Zimmer
*Assistant Examiner* — Eric Scott Sherman
(74) *Attorney, Agent, or Firm* — Mark Warzel

(57) ABSTRACT

An improved method for recovering metals from spent catalysts, particularly from spent slurry catalysts, is disclosed. The method and associated processes comprising the method are useful to recover catalyst metals used in the petroleum and chemical processing industries. The method generally involves a pyrometallurgical method and a hydrometallurgical method and includes forming a soda ash calcine of a caustic leach residue of the spent catalyst
(Continued)

containing an insoluble Group VIII/Group VIB/Group VB metal compound combined with soda ash, and extracting and recovering soluble Group VIB metal and soluble Group VB metal compounds from the soda ash calcine.

30 Claims, 3 Drawing Sheets

(56) References Cited

U.S. PATENT DOCUMENTS

| | | | | |
|---|---|---|---|---|
| 4,495,157 | A | 1/1985 | Sebenik et al. | |
| 4,495,457 | A | 1/1985 | Stahl | |
| 4,666,685 | A | 5/1987 | Wiewiorowski | |
| 4,963,520 | A | 10/1990 | Yoo et al. | |
| 5,114,687 | A | 5/1992 | Han et al. | |
| 5,498,586 | A | 3/1996 | Dai | |
| 5,702,500 | A * | 12/1997 | Llanos | B01J 23/94 423/150.2 |
| 5,968,348 | A | 10/1999 | Sherwood, Jr. | |
| 5,980,730 | A | 11/1999 | Morel | |
| 6,030,915 | A | 2/2000 | De Boer | |
| 6,180,072 | B1 | 1/2001 | Veal | |
| 6,589,908 | B1 | 7/2003 | Ginestra | |
| 6,667,271 | B2 | 12/2003 | Bartholdy | |
| 7,185,870 | B2 | 3/2007 | Hong | |
| 7,214,309 | B2 | 5/2007 | Chen | |
| 7,238,273 | B2 | 7/2007 | Chen | |
| 7,255,795 | B2 | 8/2007 | Sentimenti | |
| 7,390,398 | B2 | 6/2008 | Farshid | |
| 7,431,823 | B2 | 10/2008 | Farshid | |
| 7,431,824 | B2 | 10/2008 | Chen | |
| 7,449,103 | B2 | 11/2008 | Lott | |
| 7,485,267 | B2 | 2/2009 | Marcantonio | |
| 7,517,446 | B2 | 4/2009 | Lott | |
| 7,560,407 | B2 | 7/2009 | Klein | |
| 7,578,928 | B2 | 8/2009 | Lott | |
| 7,618,530 | B2 | 11/2009 | Satchell, Jr. | |
| 7,642,212 | B2 | 1/2010 | Klein | |
| 7,658,895 | B2 | 2/2010 | Bhaduri | |
| 7,708,877 | B2 | 5/2010 | Farshid | |
| 7,736,607 | B2 | 6/2010 | Marcantonio | |
| 7,737,068 | B2 | 6/2010 | Powers | |
| 7,790,646 | B2 | 9/2010 | Lopez | |
| 7,803,266 | B2 | 9/2010 | Guillaume | |
| 7,837,960 | B2 | 11/2010 | Bhaduri | |
| 7,846,404 | B2 | 12/2010 | Bhaduri et al. | |
| 7,897,035 | B2 | 3/2011 | Chabot | |
| 7,897,036 | B2 | 3/2011 | Chabot | |
| 7,901,569 | B2 | 3/2011 | Farshid | |
| 8,024,232 | B2 | 9/2011 | Mori | |
| 8,057,763 | B2 | 11/2011 | Oogjen et al. | |
| 8,236,169 | B2 | 8/2012 | Nguyen | |
| 8,628,735 | B2 | 1/2014 | Bhaduri | |
| 8,778,828 | B2 | 7/2014 | Mironov | |
| 8,815,184 | B2 | 8/2014 | Bhaduri | |
| 8,815,185 | B1 | 8/2014 | Bhaduri | |
| 9,206,361 | B2 | 12/2015 | Chabot | |
| 9,809,870 | B2 | 11/2017 | Bhaduri et al. | |
| 9,920,260 | B2 | 3/2018 | Ojo | |
| 10,213,772 | B2 | 2/2019 | Zhang | |
| 10,316,254 | B2 | 6/2019 | Molina | |
| 10,913,054 | B2 | 2/2021 | Zhang | |
| 11,001,502 | B2 | 5/2021 | Ojo | |
| 2004/0219082 | A1 | 11/2004 | Matjie | |
| 2006/0060502 | A1 | 3/2006 | Soled | |
| 2006/0135631 | A1 | 6/2006 | Kopponen | |
| 2007/0025899 | A1 | 2/2007 | Marcantonio | |
| 2007/0161505 | A1 | 7/2007 | Pereira-Almao | |
| 2009/0023965 | A1 | 1/2009 | Pereira | |
| 2009/0107891 | A1 | 4/2009 | Kuperman | |
| 2009/0133536 | A1 | 5/2009 | Bhaduri | |
| 2009/0159505 | A1 | 6/2009 | Da Costa | |
| 2009/0163347 | A1 | 6/2009 | Shah | |
| 2009/0163348 | A1 | 6/2009 | Da Costa | |
| 2009/0200204 | A1 | 8/2009 | Mironov | |
| 2009/0310435 | A1 | 12/2009 | Lott | |
| 2010/0163459 | A1 | 7/2010 | Odueyungbo | |
| 2010/0163499 | A1 | 7/2010 | Odueyungbo | |
| 2010/0167910 | A1 | 7/2010 | Odueyungbo | |
| 2010/0167912 | A1 | 7/2010 | Odueyungbo | |
| 2010/0234212 | A1 | 9/2010 | Brait | |
| 2011/0005976 | A1 | 1/2011 | Rispoli | |
| 2011/0014097 | A1 | 1/2011 | Amelunxen | |
| 2011/0129397 | A1 * | 6/2011 | Shiokawa | C22B 23/026 423/53 |
| 2011/0226667 | A1 | 9/2011 | Lott | |
| 2011/0306490 | A1 | 12/2011 | Bhattacharyya | |
| 2012/0051988 | A1 | 3/2012 | Marafi | |

FOREIGN PATENT DOCUMENTS

| | | | | |
|---|---|---|---|---|
| CN | 101500944 | B | 4/2012 | |
| CN | 101517104 | B | 1/2013 | |
| CN | 103119182 | A | 5/2013 | |
| CN | 110177777 | A | 8/2019 | |
| CN | 109652652 | B | 7/2020 | |
| CN | 113564368 | B | 4/2022 | |
| CN | 112746171 | B | 4/2023 | |
| FR | 2668389 | * | 4/1992 | B01J 23/94 |
| JP | S59152218 | A | 8/1984 | |
| KR | 20070096139 | A | 10/2007 | |
| KR | 20080038193 | A | 5/2008 | |
| KR | 20100101615 | A | 9/2010 | |
| WO | 20060117101 | A1 | 11/2006 | |
| WO | 2007018805 | A2 | 2/2007 | |
| WO | 2009070778 | A2 | 6/2009 | |
| WO | 2010142397 | A2 | 12/2010 | |
| WO | 2012027532 | A2 | 3/2012 | |
| WO | 2021005526 | A1 | 1/2021 | |
| WO | 2021150552 | A1 | 7/2021 | |

OTHER PUBLICATIONS

"Ullmann's Encyclopedia of Industrial Chemistry." Fifth Edition, vol. A16.

Bartholomew et al., "Catalyst Deactivation, Regeneration and Disposal", The Catalyst Group Resources, Spring House, PA.

Furimsky et al. "Deactivation of hydroprocessing catalysts." Catalysis Today 52.4 (1999): 381-495.

Furimsky, E. Selection of catalysts and reactors for hydroprocessing. Applied Catalysis A: General 171 (1998) 177-206. (Year: 1998).

Kar et al. "Spent catalyst: secondary source for molybdenum recovery." Hydrometallurgy 72.1-2 (2004): 87-92.

Llanos et al., "Processes for the Recovery of Metals from Spent Hydroprocessing Catalysts", Third International Symposium on Recycling of Metals and Engineered Materials, TMMS, 1995, p. 425.

Llanos et al., "Treatment of Spent Hydroprocessing Catalysts at Gulf Chemical and Metallurgical Corporation", SME Annual Meeting, Mar. 1986, New Orleans, Louisiana.

Marafi et al. "Options and processes for spent catalyst handling and utilization." Journal of hazardous materials 101.2 (2003): 123-132.

Marafi et al. "The recovery of valuable metals and recycling of alumina from a waste spent hydroprocessing catalyst: extraction with Na salts." WIT Trans Ecol Environ 180.2014 (2014): 15-27.

Morishita et al. "Calorimetric study of nickel molybdate: heat capacity, enthalpy, and Gibbs energy of formation." Journal of the American Ceramic Society 86.11 (2003): 1927-1932.

PCT International Search Report and Written Opinion mailed on Jun. 2, 21, issued in International Application No. PCT/US2021/014098, filed on Jan. 20, 2021, 18 pages.

PCT International Search Report and Written Opinion mailed on Sep. 28, 2020 issued in Application No. PCT/IB2020/056420, filed on Jul. 8, 2020, 11 pages.

PCT International Search Report and Written Opinion mailed on Oct. 31, 2022, issued in International Application No. PCT/US2022/029214, filed on May 13, 2022, 9 pages.

(56) References Cited

OTHER PUBLICATIONS

Roine, HSC Chemistry® [Software], Outotec, Pori 2018. Software available at www.outotec.com/HSC.
Treadwell, "Analytical Chemistry." 5th Edition, 1919.
Vogel, "Qualitative Inorganic Analysis." 4th Edition, 1953.

* cited by examiner

METALS RECOVERY FROM SPENT CATALYST

CROSS REFERENCE TO RELATED APPLICATIONS

This application claims the benefit of priority to U.S. Provisional Patent Appl. Ser. Nos. 62/871,258, filed on Jul. 8, 2019, and 62/962,222, filed on Jan. 20, 2020, and to PCT Appl. No. PCT/IB2020/056420, filed on Jul. 8, 2020, the disclosures of which are herein incorporated in their entirety.

FIELD OF THE INVENTION

The invention concerns a method for recovering metals from spent catalysts, including spent slurry hydroprocessing catalysts.

BACKGROUND OF THE INVENTION

Catalysts have been widely used in the refining and chemical processing industries for many years. Hydroprocessing catalysts, including hydrotreating and hydrocracking catalysts, are now widely employed in facilities worldwide. Used or "spent" hydroprocessing catalysts that are no longer sufficiently active (or that require replacement for other reasons) typically contain metal components such as molybdenum, nickel, cobalt, vanadium, and the like.

With the advent of heavier crude feedstock, refiners are forced to use more catalysts than before for hydroprocessing and to remove sulfur and contaminants for catalysts from the feedstock. These catalytic processes generate significant quantities of spent catalyst having market price for metal values and environmental awareness thereof, catalysts can serve as a source for metal recovery.

Various processes for recovering catalyst metals from spent catalysts are described in the literature. U.S. Pat. No. 7,255,795, for example, describes the extraction of molybdenum as molybdenum xanthate from other metal elements, including vanadium, from liquid mixtures by potassium ethyl xanthate at an acidic pH with the use of agents such as hydrochloric acid. US Patent Publication No. 2007/0025899 discloses a process to recover metals such as molybdenum, nickel, and vanadium from a spent catalyst with a plurality of steps and equipment to recover the molybdenum and nickel metal complexes. U.S. Pat. No. 6,180,072 discloses another complex process requiring oxidation steps and solvent extraction to recover metals from spent catalysts containing at least a metal sulphide. U.S. Pat. No. 7,846,404 discloses a process using pH adjustment and precipitation, for recovery of metals from ammoniacal pressure leach solution generated through oxidative pressure leaching of spent catalyst. US Patent Publication No. 2007/0,025,899 further discloses a process to recover metals such as molybdenum, nickel, and vanadium from a spent catalyst with a plurality of steps and equipment to recover the molybdenum and nickel metal complexes. U.S. Pat. No. 6,180,072 discloses another complex process requiring solvent extraction as well as oxidation steps to recover metals from spent catalysts containing at least a metal sulphide.

Despite the progress made in recovering catalyst metals from spent catalysts, particularly in hydrometallurgical methods, a continuing need exists for an improved and simplified process to recover catalyst metals from spent catalysts, including but not limited to molybdenum, nickel, and vanadium.

SUMMARY OF THE INVENTION

The present invention is directed to a method for recovering catalyst metals from spent catalysts, particularly spent hydroprocessing catalysts such as slurry catalysts. One of the goals of the invention is to provide improvements in spent catalyst metals recovery processes that provide lower capital and operating costs for metals recovery, preferably at increased metals recovery efficiency. The invention provides an innovative and cost-effective approach for catalyst metals recovery, while also providing improvements in overall catalyst metals recovery, that addresses important needs in the oil and gas and metals recovery industries.

An improved method for recovering metals from spent catalysts, particularly from spent slurry catalysts, is disclosed. The method and associated processes comprising the method are useful to recover catalyst metals used in the petroleum and chemical processing industries. The method generally involves both pyrometallurgical and hydrometallurgical techniques and methods. The pyrometallurgical method involves forming a soda ash calcine of a caustic leach residue of the spent catalyst, the calcine containing an insoluble Group VIII/Group VIB/Group VB metal compound combined with soda ash, and extracting and recovering soluble Group VIB metal and soluble Group VB metal compounds from the soda ash calcine. The hydrometallurgical method, which may be used together with the pyrometallurgical method, involves a metathesis reaction of a mixture of Group VB metal oxide and Group VIB metal oxide compounds with an ammonium salt, crystallization and separation of ammonium Group VB metal oxide compound metathesis product followed by ammonia removal to form and recover Group VB metal oxide compound, and separate acidulation of ammonium Group VIB metal oxide compound to form and recover Group VIB metal oxide compound precipitate.

In one aspect, the pyrometallurgical method comprises heating a deoiled spent catalyst comprising a Group VIB metal, a Group VIII metal, and a Group VB metal under oxidative conditions at a first pre-selected temperature for a first time sufficient to reduce the levels of sulfur and carbon present in the catalyst to less than pre-selected amounts and to form a calcined spent catalyst; contacting the calcined spent catalyst with a caustic leach solution to form a spent catalyst slurry at a pre-selected leach temperature for a pre-selected leach time and at a pre-selected leach pH; separating and removing a filtrate and a solid residue from the spent catalyst slurry, the filtrate comprising a soluble Group VIB metal compound and a soluble Group VB metal compound and the solid residue comprising an insoluble Group VIII/Group VIB/Group VB metal compound; drying the insoluble Group VIII/Group VIB/Group VB metal compound solid residue; combining the dried Group VIII/Group VIB/Group VB metal compound solid residue with anhydrous soda ash to form a solid residue/soda ash mixture; heating the metal compound solid residue/soda ash mixture at a second pre-selected temperature and for a second pre-selected time under gas flow conditions to form a soda ash calcine; contacting the soda ash calcine with water to form a soda ash calcine slurry at a temperature and for a time sufficient to leach a soluble Group VIB metal compound and a soluble Group VB metal compound from the soda ash calcine; separating and removing a filtrate and a solid residue from the soda ash calcine slurry, the filtrate comprising the soluble Group VIB metal compound and the soluble Group VB metal compound and the solid residue comprising an insoluble Group VIII metal compound; and recovering the soluble Group VIB metal compound and the soluble Group VB metal compound from the spent catalyst slurry filtrate and from the soda ash calcine slurry filtrate.

In another aspect, the method generally relates to the use of soda ash to increase the recovery of metals from spent catalysts, in which a soda ash calcine is formed by combining soda ash with the solid residue from a caustic leach extraction of soluble Group VIB metal and soluble Group VB metal compounds from the spent catalyst, with the soluble Group VIB metal and soluble Group VB metal compounds then extracted and recovered from the soda ash calcine.

In a further aspect, the hydrometallurgical method comprises separately recovering Group VIB and Group VB metal compounds from a mixture comprising the Group VIB and Group VB metal compounds by contacting the Group VIB/Group VB metal compound mixture with an ammonium salt under metathesis reaction conditions effective to convert the metal compounds to ammonium Group VB metal and ammonium Group VIB metal compounds; subjecting the mixture comprising the ammonium Group VB metal compound to conditions effective to crystallize the ammonium Group VB metal compound; filtering and washing the crystallized ammonium Group VB metal compound with a saturated ammonium Group VB metal compound wash solution at a pre-selected wash temperature and separately recovering the ammonium Group VB metal compound and an ammonium Group VIB metal compound filtrate; heating the ammonium Group VB metal compound under conditions effective to release ammonia and separately recovering the Group VB metal compound and ammonia; contacting the ammonium Group VIB metal compound filtrate with an inorganic acid under conditions effective to form a Group VIB metal oxide compound precipitate and an ammonium salt of the inorganic acid; filtering and washing the Group VIB metal oxide compound precipitate with a saturated ammonium Group VIB metal oxide compound wash solution at a pre-selected wash temperature and recovering the Group VIB metal oxide compound precipitate.

BRIEF DESCRIPTION OF THE DRAWINGS

The scope of the invention is not limited by any representative figures accompanying this disclosure and is to be understood to be defined by the claims of the application.

DETAILED DESCRIPTION

Figure 1:
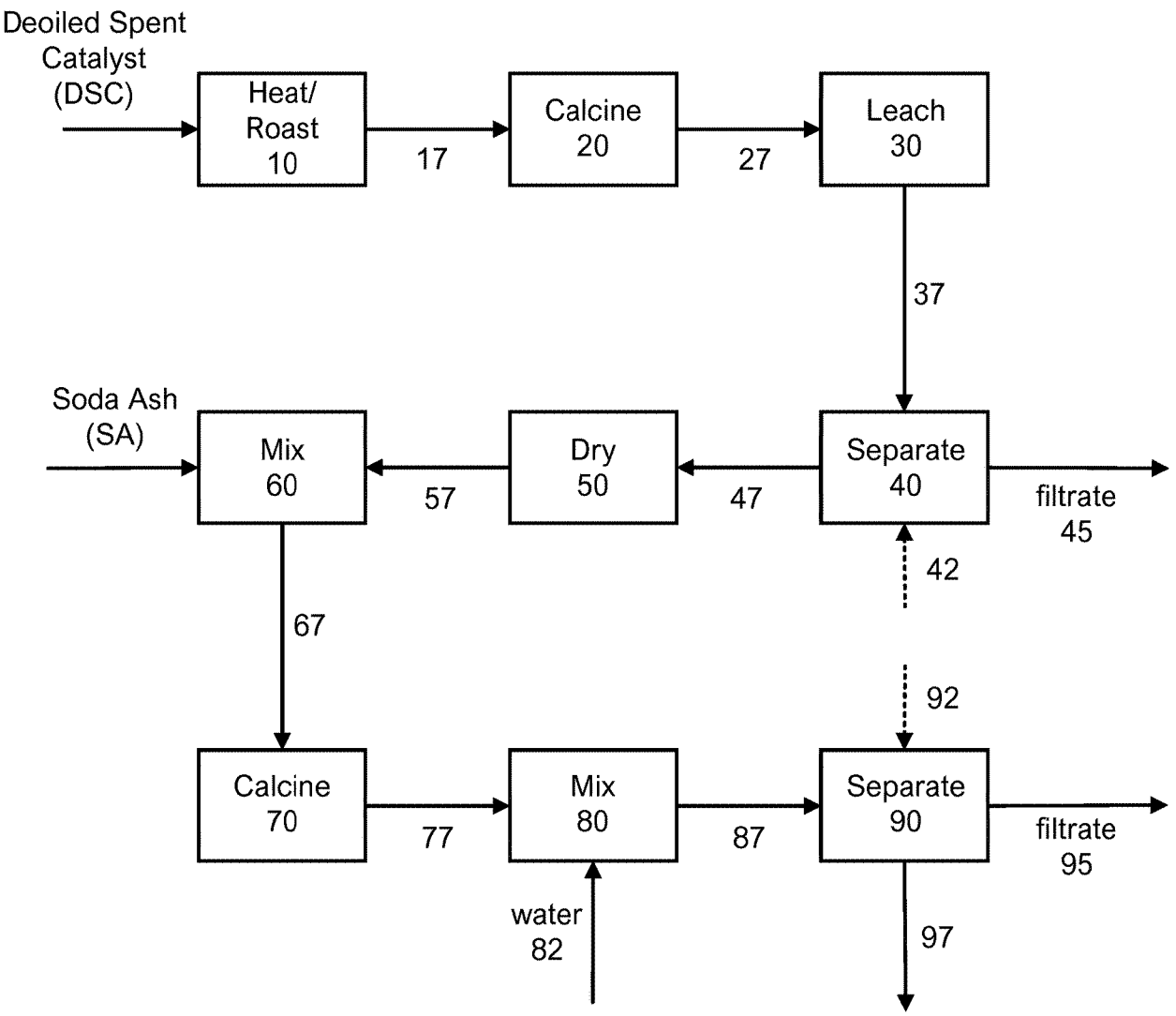
FIG. 1 is a general block diagram schematic illustration of an embodiment of a pyrometallurgical method to recover metals from deoiled spent catalyst according to the invention.

Although illustrative embodiments of one or more aspects are provided herein, the disclosed processes may be implemented using any number of techniques. The disclosure is not limited to the illustrative or specific embodiments, drawings, and techniques illustrated herein, including any exemplary designs and embodiments illustrated and described herein, and may be modified within the scope of the appended claims along with their full scope of equivalents.

Unless otherwise indicated, the following terms, terminology, and definitions are applicable to this disclosure. If a term is used in this disclosure but is not specifically defined herein, the definition from the IUPAC Compendium of Chemical Terminology, 2nd ed (1997), may be applied, provided that definition does not conflict with any other disclosure or definition applied herein, or render indefinite or non-enabled any claim to which that definition is applied. To the extent that any definition or usage provided by any document incorporated herein by reference conflicts with the definition or usage provided herein, the definition or usage provided herein is to be understood to apply.

"Slurry catalyst" may be used interchangeably with "bulk catalyst" or "unsupported catalyst" or "self-supported catalyst," meaning that the catalyst composition is not of the conventional catalyst form with a preformed, shaped catalyst support which is then loaded with metals via impregnation or deposition catalyst. Such bulk catalyst may be formed through precipitation, or may have a binder incorporated into the catalyst composition. Slurry or bulk catalyst may also be formed from metal compounds and without any binder. In slurry form, such catalyst comprises dispersed particles in a liquid mixture such as hydrocarbon oil, i.e., a "slurry catalyst".

"Heavy oil" feed or feedstock refers to heavy and ultra-heavy crudes, including but not limited to resids, coals, bitumen, tar sands, oils obtained from the thermo-decomposition of waste products, polymers, biomasses, oils deriving from coke and oil shales, etc. Heavy oil feedstock may be liquid, semi-solid, and/or solid. Examples of heavy oil feedstock include but are not limited to Canada Tar sands, vacuum resid from Brazilian Santos and Campos basins, Egyptian Gulf of Suez, Chad, Venezuelan Zulia, Malaysia, and Indonesia Sumatra. Other examples of heavy oil feedstock include residuum left over from refinery processes, including "bottom of the barrel" and "residuum" (or "resid"), atmospheric tower bottoms, which have a boiling point of at least 650° F. (343° C.), or vacuum tower bottoms, which have a boiling point of at least 975° F. (524° C.), or "resid pitch" and "vacuum residue" which have a boiling point of 975° F. (524° C.) or greater.

"Treatment," "treated," "upgrade," "upgrading" and "upgraded," when used in conjunction with a heavy oil feedstock, describes a heavy oil feedstock that is being or has been subjected to hydroprocessing, or a resulting material or crude product, having a reduction in the molecular weight of the heavy oil feedstock, a reduction in the boiling point range of the heavy oil feedstock, a reduction in the concentration of asphaltenes, a reduction in the concentration of hydrocarbon free radicals, and/or a reduction in the quantity of impurities, such as sulfur, nitrogen, oxygen, halides, and metals.

The upgrade or treatment of heavy oil feeds is generally referred herein as "hydroprocessing" (hydrocracking, or hydroconversion). Hydroprocessing is meant as any process that is carried out in the presence of hydrogen, including, but not limited to, hydroconversion, hydrocracking, hydrogenation, hydrotreating, hydrodesulfurization, hydrodenitrogenation, hydrodemetallation, hydrodearomatization, hydroisomerization, hydrodewaxing and hydrocracking including selective hydrocracking.

The term "Hydrogen" or "hydrogen" refers to hydrogen itself, and/or a compound or compounds that provide a source of hydrogen.

"Hydrocarbonaceous", "hydrocarbon" and similar terms refer to a compound containing only carbon and hydrogen atoms. Other identifiers may be used to indicate the presence of particular groups, if any, in the hydrocarbon (e.g., halogenated hydrocarbon indicates the presence of one or more halogen atoms replacing an equivalent number of hydrogen atoms in the hydrocarbon).

"Spent catalyst" refers to a catalyst that has been used in a hydroprocessing operation and whose activity has thereby been diminished. In general, a catalyst may be termed "spent" if a reaction rate constant of the catalyst is below a certain specified value relative to a fresh catalyst at a specified temperature. In some circumstances, a catalyst may be "spent" is the reaction rate constant, relative to fresh unused catalyst, is 80% or less, or perhaps 50% or less in another embodiment. In one embodiment, the metal components of the spent catalyst comprise at least one of Group VB, VIB, and VIII metals (of the Periodic Table), e.g., vanadium (V), molybdenum (Mo), tungsten (W), nickel (Ni), and cobalt (Co). The most commonly encountered metal to be recovered is Mo. While not necessarily limited thereto, the spent catalyst typically contains sulfides of Mo, Ni, and V.

"Deoiled spent catalyst" generally refers to a "spent catalyst", as described hereinabove, that has been subjected to a deoiling process. In general, deoiled spent catalyst contains some residual oil hydrocarbons, such as unconverted oil and/or hydroprocessing products, as well as other chemical compounds and materials. For example, deoiled spent catalyst may typically contain 15 wt. % or more residual hydrocarbons, or, if processed to remove such hydrocarbons, a reduced amount, such as 1 wt. % or less, or 1000 ppm or less. Content specifications for such additional components are specified herein, as appropriate, whether in general or specific terms.

"Metal" refers to metals in their elemental, compound, or ionic form. "Metal precursor" refers to the metal compound feed in a method or to a process. The term "metal", "metal precursor", or "metal compound" in the singular form is not limited to a single metal, metal precursor, or metal compound, e.g., a Group VIB, Group VIII, or Group V metal, but also includes the plural references for mixtures of metals. The terms "soluble" and "insoluble" in reference to a Group VIB, Group VIII, or Group V metal or metal compound means the metal component is in a protic liquid form unless otherwise stated, or that the metal or metal compound is soluble or insoluble in a specified step or solvent.

"Group IIB" or "Group IIB metal" refers to zinc (Zn), cadmium (Cd), mercury (Hg), and combinations thereof in any of elemental, compound, or ionic form.

"Group IVA" or" "Group IVA metal" refers to germanium (Ge), tin (Sn) or lead (Pb), and combinations thereof in any of elemental, compound, or ionic form.

"Group V metal" refers to vanadium (V), niobium (Nb), tantalum (Ta), and combinations thereof in their elemental, compound, or ionic form.

"Group VIB" or "Group VIB metal" refers to chromium (Cr), molybdenum (Mo), tungsten (W), and combinations thereof in any of elemental, compound, or ionic form.

"Group VIII" or "Group VIII metal" refers to iron (Fe), cobalt (Co), nickel (Ni), ruthenium (Ru), rhenium (Rh), rhodium (Ro), palladium (Pd), osmium (Os), iridium (Ir), platinum (Pt), and combinations thereof in any of elemental, compound, or ionic form.

The reference to Mo or "molybdenum" is by way of exemplification only as a Group VIB metal, and is not meant to exclude other Group VIB metals/compounds and mixtures of Group VIB metals/compounds. Similarly, the reference to "nickel" is by way of exemplification only and is not meant to exclude other Group VIII non-noble metal components; Group VIIIB metals; Group VIB metals; Group IVB metals; Group IIB metals and mixtures thereof that can be used in hydroprocessing catalysts. Similarly, the reference to "vanadium" is by way of exemplification only for any Group VB metal component that may be present in spent catalysts, and is not intended to exclude other Group VB metals/compounds and mixtures that may be present in the spent catalyst used for metal recovery.

The description of a combination of metal compounds represented by the use of the term "Group VIII/Group VIB/Group VB" to describe metal compounds that may be present is intended to mean that Group VIII, Group VIB or Group VB metal compounds may be present, as well as any combination thereof. For example, if the spent catalyst comprises metal compounds of Mo, V, Ni, and Fe, as oxygen and/or sulfur-containing compounds, the term "Group VIII/Group VIB/Group VB" should be understood to include single and mixed metal compounds, i.e., metal compounds comprising Group VIII, Group VIB, Group VB metals, or a combination thereof. Representative compounds include, e.g., $MoS_2$, $V_2S_3$, NiS, FeS, $MoO_3$, $V_2O_3$, NiO, $V_2O_5$, $Fe_2O_3$, $NiMoO_4$, $FeVO_4$, and the like. Similarly, the term "Group VB/Group VIB" metal(s) and metal oxide(s) refers to metal or metal oxide compounds comprising Group VB, Group VIB metals, or a combination thereof.

The term "support", particularly as used in the term "catalyst support", refers to conventional materials that are typically a solid with a high surface area, to which catalyst materials are affixed. Support materials may be inert or participate in the catalytic reactions, and may be porous or non-porous. Typical catalyst supports include various kinds of carbon, alumina, silica, and silica-alumina, e.g., amorphous silica aluminates, zeolites, alumina-boria, silica-alumina-magnesia, silica-alumina-titania and materials obtained by adding other zeolites and other complex oxides thereto.

"Molecular sieve" refers to a material having uniform pores of molecular dimensions within a framework structure, such that only certain molecules, depending on the type of molecular sieve, have access to the pore structure of the molecular sieve, while other molecules are excluded, e.g., due to molecular size and/or reactivity. Zeolites, crystalline aluminophosphates and crystalline silicoaluminophosphates are representative examples of molecular sieves.

In this disclosure, while compositions and methods or processes are often described in terms of "comprising" various components or steps, the compositions and methods may also "consist essentially of" or "consist of" the various components or steps, unless stated otherwise.

The terms "a," "an," and "the" are intended to include plural alternatives, e.g., at least one. For instance, the disclosure of "a transition metal" or "an alkali metal" is meant to encompass one, or mixtures or combinations of more than one, transition metal or alkali metal, unless otherwise specified.

All numerical values within the detailed description and the claims herein are modified by "about" or "approximately" the indicated value, and take into account experimental error and variations that would be expected by a person having ordinary skill in the art.

The present invention is a method for recovering metals from a deoiled spent catalyst. In one aspect, the method includes a pyrometallurgical method comprising:

heating a deoiled spent catalyst comprising a Group VIB metal, a Group VIII metal, and a Group VB metal under oxidative conditions at a first pre-selected temperature for a first time sufficient to reduce the levels of sulfur and carbon to less than pre-selected amounts and to form a calcined spent catalyst;

contacting the calcined spent catalyst with a caustic leach solution to form a spent catalyst slurry at a pre-selected leach temperature for a pre-selected leach time and at a pre-selected leach pH;

separating and removing a filtrate and a solid residue from the spent catalyst slurry, the filtrate comprising a soluble Group VIB metal compound and a soluble Group VB metal compound and the solid residue comprising an insoluble Group VIII/Group VIB/Group VB metal compound;

drying the insoluble Group VIII/Group VIB/Group VB metal compound solid residue;

combining the dried Group VIII/Group VIB/Group VB metal compound solid residue with anhydrous soda ash to form a solid residue/soda ash mixture;

heating the metal compound solid residue/soda ash mixture at a second pre-selected temperature and for a second pre-selected time under gas flow conditions to form a soda ash calcine;

contacting the soda ash calcine with water to form a soda ash calcine slurry at a temperature and for a time sufficient to leach a soluble Group VIB metal compound and a soluble Group VB metal compound from the soda ash calcine;

separating and removing a filtrate and a solid residue from the soda ash calcine slurry, the filtrate comprising the soluble Group VIB metal compound and the soluble Group VB metal compound and the solid residue comprising an insoluble Group VIII metal compound; and recovering the soluble Group VIB metal compound and the soluble Group VB metal compound from the spent catalyst slurry filtrate and from the soda ash calcine slurry filtrate.

The inventive method provides for an improved recovery of catalyst metals through the use of two leaching extraction stages, the first being a caustic leach extraction of the deoiled spent catalyst and the second being a water leaching extraction of a soda ash calcine formed from the insoluble residue obtained from the caustic leach extraction stage combined with soda ash. The method does not require the use of additional extraction stages (within the method), such as the addition of other solvents, or the use of additional treatment organic and/or inorganic compounds in combination with the caustic leach solution or with the use of soda ash. As such, the method provides a cost-effective simplified approach to the recovery of metals from spent catalyst.

The spent catalyst generally originates from a bulk unsupported Group VIB metal sulfide catalyst optionally containing a metal selected from a Group VB metal such as V, Nb; a Group VIII metal such as Ni, Co; a Group VIIIB metal such as Fe; a Group IVB metal such as Ti; a Group IIB metal such as Zn, and combinations thereof. Certain additional metals may be added to a catalyst formulation to improve selected properties, or to modify the catalyst activity and/or selectivity. The spent catalyst may originate from a dispersed (bulk or unsupported) Group VIB metal sulfide catalyst promoted with a Group VIII metal for hydrocarbon oil hydroprocessing, or, in another embodiment, the spent catalyst may originate from a Group VIII metal sulfide catalyst. The spent catalyst may also originate from a catalyst consisting essentially of a Group VIB metal sulfide, or, in another embodiment, the spent catalyst may originate from a bulk catalyst in the form of dispersed or slurry catalyst. The bulk catalyst may be, e.g., a colloidal or molecular catalyst.

Catalysts suitable for use as the spent catalyst in the method are described in a number of publications, including US Patent Publication Nos. US20110005976A1, US20100294701A1, US20100234212A1, US20090107891A1, US20090023965A1, US20090200204A1, US20070161505A1, US20060060502A1, and US20050241993A.

The bulk catalyst in one embodiment is used for the upgrade of heavy oil products as described in a number of publications, including U.S. Pat. Nos. 7,901,569, 7,897,036, 7,897,035, 7,708,877, 7,517,446, 7,431,824, 7,431,823, 7,431,822, 7,214,309, 7,390,398, 7,238,273 and 7,578,928; US Publication Nos. US20100294701A1, US20080193345A1, US20060201854A1, and US20060054534A1, the relevant disclosures are included herein by reference.

Prior to metal recovery and after the heavy oil upgrade, the spent catalyst may be treated to remove residual hydrocarbons such as oil, precipitated asphaltenes, other oil residues and the like. The spent catalyst prior to deoiling contains typically carbon fines, metal fines, and (spent) unsupported slurry catalyst in unconverted resid hydrocarbon oil, with a solid content ranging from 5 to 50 wt. %. The deoiling process treatment may include the use of solvent for oil removal, and a subsequent liquid/solid separation step for the recovery of deoiled spent catalyst. The treatment process may further include a thermal treatment step, e.g., drying and/or pyrolizing, for removal of hydrocarbons from the spent catalyst. In other aspects, the deoiling may include the use of a sub-critical dense phase gas, and optionally with surfactants and additives, to clean/remove oil from the spent catalyst.

The spent catalyst after deoiling typically contains less than 5 wt. % hydrocarbons as unconverted resid, or, more particularly, less than 2 wt. % hydrocarbons, or less than 1 wt. % hydrocarbons. The amount of metals to be recovered in the de-oiled spent catalyst generally depends on the compositional make-up of the catalyst for use in hydroprocessing, e.g., a sulfided Group VIB metal catalyst, a bimetallic catalyst containing a Group VIB metal and a Group VIII metal, or a multi-metallic catalyst with at least a Group VIB and other (e.g., promoter) metal(s). After the oil removal treatment process, the spent catalyst containing metals for recovery may be in the form of a coke-like material, which can be ground accordingly for the subsequent metal recovery process to a particle size typically ranging from 0.01 to about 100 microns.

The deoiling or removal of hydrocarbons from spent catalyst is disclosed in a number of publications, including U.S. Pat. Nos. 7,790,646, 7,737,068, WO20060117101, WO2010142397, US20090159505A1, US20100167912A1, US20100167910A1, US20100163499A1, US20100163459A1, US20090163347A1, US20090163348A1, US20090163348A1, US20090159505A1, US20060135631A1, and US20090163348A1.

An illustration of a pyrometallurgical method or process according to an embodiment of the invention is shown schematically in FIG. 1. Deoiled spent catalyst (DSC), e.g., catalyst that is devoid or substantially devoid of residual hydrocarbons, as described herein, is fed to a heating or roasting stage 10 to reduce the sulfur and/or carbon content present in the catalyst to less than pre-selected amounts and subsequently 17 to form a calcined spent catalyst in calcining stage 20. The heating/roasting and calcining steps may be conducted in the same or different equipment and as individual batch or continuous process steps. Off-gassing of sulfur and carbon from the catalyst may be used to establish the amount of time needed for calcination (or the completion of the calcination step), as previously described. The spent catalyst calcine is subsequently 27 subjected to an extraction (leaching) stage 30 with caustic leach comprising NaOH (e.g., at a pH of about 10.2), typically at about 15 wt. % solids content, and at about 75° C. for a few (2-3) hours. The leach slurry is subsequently 37 subjected to separation 40 of the filtrate 45 from the solid residue, typically with a wash 42 of, e.g., alkaline hot water. The filtrate comprises soluble Group VIB and Group VB metals and is separated for subsequent 47 recovery of the metals while the insoluble solid residue is dried 50, e.g., at 125° C. until the water content is less than a suitable amount, e.g., about 1 wt. %. The dried solid residue is subsequently 57 mixed 60 with anhydrous soda ash (e.g., particulate soda ash having a particle size that is predominantly less than 100 μm) and the dried mixture is subsequently 67 calcined 70. Typical calcination conditions to form the soda ash calcine include temperatures in the range of 600-650° C. The soda ash calcine is subsequently 77 mixed with water 80 to form a soda ash calcine slurry, typically at a temperature of 60-90° C. in order to extract soluble Group VIB and Group VB metal compounds. The slurry is subsequently 87 separated 90 into a filtrate 95 comprising the soluble Group VIB and Group VB metal compounds and a residue 96 comprising insoluble compounds (such as, e.g., Ni, Fe and other metal compounds). Filtrates 45 and 95 may be subjected to further processing to recover the Group VB and Group VIB metal compounds, e.g., in the case of vanadium and molybdenum, as $V_2O_5$ and $MoO_3$. Residue 96 may also be further processed for possible metals recovery or sent to a smelter.

The initial heating/roasting stage (10 in FIG. 1) is generally used, when needed or as appropriate, to remove residual hydrocarbons before subsequent calcining of the spent catalyst. For deoiled spent catalyst having a low content of residual hydrocarbons, e.g., less than about 1000 ppm, such as may be obtained for catalyst that has been pre-processed, the initial heating/roasting stage may not be needed. While not limited thereto, the heating may comprise, e.g., a slow ramp to an initial temperature, e.g., in the range of 350-500° C., under an inert gas such as argon, for a suitable period of time to remove residual hydrocarbons (e.g., 1-2 hr).

Calcining of the spent catalyst is subsequently carried out, typically by increasing the temperature to an appropriate calcining temperature, e.g., in the range of 600-650° C., under oxidative gas conditions (e.g., a mixture of an inert gas such as argon and air), for a suitable period of time to form a calcined spent catalyst (e.g., typically greater than 1-2 hr and less than about 24 hr, or more particularly, less than about 12 hr). In general, the calcined spent catalyst may also be monitored by off-gas analysis for removal of $CO_2$ and $SO_2$ during the calcination stage to determine a suitable end point to the calcination. For example, an end point may be associated with $CO_2$ and $SO_2$ levels of less than about 1 wt. %, or about 0.8 wt. %, or about 0.5 wt. %, or about 0.2 wt. %, or about 0.1 wt. %.

During the spent catalyst calcination step, oxidative heating conditions generally comprise heating in the presence of an inert gas, air, or a combination thereof. Variations in the oxidative conditions may be employed as needed, e.g., an initial gas environment comprising no more than about 20 vol. % oxygen may be followed by gas conditions comprising more than about 80 vol. % oxygen may also be used.

During calcination of the spent catalyst, e.g., when the catalyst comprises, e.g., Mo, Ni, V, Fe, C, and S, the following representative reactions are believed to form soluble and insoluble metal compounds and off-gas products $$MoS_2+7/2O_2 \rightarrow MoO_3+2SO_2\uparrow$$

$$NiS+3/2O_2 \rightarrow NiO+SO_2\uparrow$$

$$V_2S_3+11/2O_2 \rightarrow V_2O_5+3SO_2\uparrow$$

$$2Fe_2S+7/2O_2 \rightarrow Fe_2O_3+2SO_2\uparrow$$

$$C+O_2 \rightarrow CO_2\uparrow$$

$$S+O_2 \rightarrow SO_2\uparrow$$

$$NiO+MoO_3 \rightarrow NiMoO_4$$

$$Fe_2O_3+V_2O_5 \rightarrow 2FeVO_4$$

Following the spent catalyst calcination, a leaching extraction step is conducted to leach soluble metal compounds, forming a first filtrate and an insoluble metal compound(s) residue comprising insoluble Group VIII/Group VIB/Group VB metal compound(s). The filtrate typically comprises soluble molybdate and vanadate compounds while the insoluble compounds typically comprise mixed metal compounds. For example, in the case of the foregoing representative reactions noted, such insoluble metal compounds are believed to comprise $NiMoO_4$ and $FeVO_4$. While not necessarily limited thereto, typical leach conditions comprise a leach temperature in the range of about 60 90° C., or 60 80° C., or 70 80° C., or greater than about 60° C., or 70° C.; a leach time in the range of about 1-5 hr, or about 2-5 hr, or about 2-4 hr.; and a leach pH in the range of about 9.5 to 11, or about 10 to 11, or about 10 to 10.5.

The first filtrate generally contains greater than about 80 wt. % of the Group VIB metal or greater than about 85 wt. % of the Group VB metal present in the deoiled spent catalyst, or both greater than about 80 wt. % of the Group VIB metal and greater than about 85 wt. % of the Group VB metal present in the deoiled spent catalyst.

The residue from the caustic leach stage typically comprises Group VB/Group VIB metal oxide solids and is subsequently separated from the filtrate and dried under suitable conditions, e.g., at a temperature in the range of about 110-140° C., or about 110-130° C., or about 120-130° C. for a time period in the range of 0.5-2 hr, or 1 2 hr. Typically, the first solid residue is dried at a temperature and for a time sufficient to reduce the amount of water to less than about 2 wt. %, or 1 wt. %, or 0.5 wt. %, or 0.2 wt. %, or 0.1 wt. %.

The dried caustic leach residue is subsequently mixed with anhydrous soda ash under suitable conditions to form a well-mixed particulate or powder mixture of the solid residue/soda ash. The solid residue/soda ash mixture is subsequently subjected to a heating/roasting calcination step to form a soda ash calcine, typically at a second pre-selected temperature in the range of about 600° C. to 650° C., or about 600° C. to 650° C., or about 610° C. to 630° C., or greater than about 600° C., or about 610° C., or about 620° C., or about 630° C., or about 640° C., or about 650° C., and for a second pre-selected time in the range of about 0.5-2 hr, or 1-2 hr. Sufficient gas flow conditions are typically used comprising an inert gas to remove any off-gases.

The soda ash calcine is subsequently contacted with water to form a soda ash calcine slurry, typically at a temperature in the range of about 60 90° C., or 60 80° C., or 70 80° C., or at a temperature greater than about 60° C., or 70° C. While not limited thereto, the soda ash calcine leach time is typically in the range of 0.5-4 hr, or 1-3 hr, or 2-3 hr. The pH may be modified as needed, although typically no pH modification is needed during this step. Representative metal compounds present in the second filtrate comprise sodium molybdate, sodium vanadate, sodium metavanadate, or a mixture thereof.

More broadly, the second filtrate contains the Group VB metal present in the Group VB/Group VIB metal oxide in an amount greater than about 90 wt. %, or about 95 wt. %, or about 97 wt., or about 98 wt., or about 99 wt. %. In addition, the second filtrate contains the Group VIB metal present in the Group VB/Group VIB metal oxide in an amount greater than about 90 wt. %, or about 95 wt. %, or about 97 wt. %, or about 98 wt. %, or about 99 wt. %.

During calcination of the solid residue/soda ash mixture, e.g., when the catalyst comprises, e.g., Mo, Ni, V, Fe, C, and S, the following representative reactions are believed to form soluble and insoluble metals and off-gas products

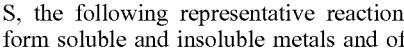

$$NiMoO_4+Na_2CO_3 \rightarrow Na_2MoO_4+NiO+CO_2\uparrow$$

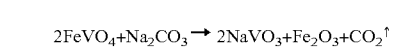

$$2FeVO_4+Na_2CO_3 \rightarrow 2NaVO_3+Fe_2O_3+CO_2\uparrow$$

The first filtrate from the caustic leach extraction stage and the second filtrate from the soda ash calcine water leach extraction stages may be further processed and/or treated to recover the soluble Group VB and Group VIB metals. Details concerning conventional steps that may be used for such further processing are not provided herein.

In terms of the overall extraction of spent catalyst metals, the overall extraction of the Group VB metal present in the deoiled spent catalyst is greater than about 90 wt. %, or about 95 wt. %, or about 97 wt. %, or about 98 wt. %, or about 99 wt. %. Similarly, the overall extraction of the Group VIB metal present in the deoiled spent catalyst is greater than about 90 wt. %, or about 95 wt. %, or about 97 wt. %, or about 98 wt. %, or about 99 wt. %.

Figure 2:
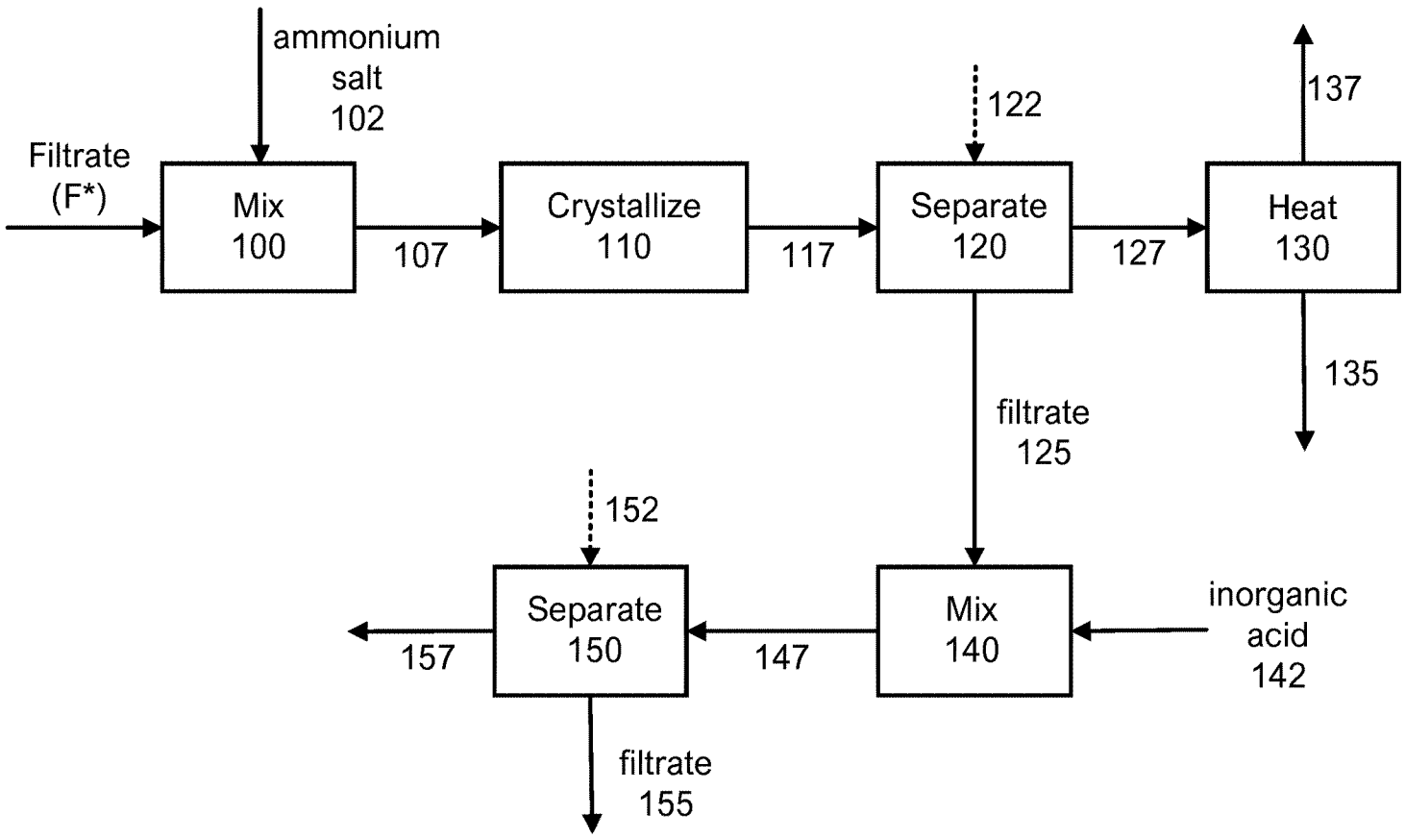
FIG. 2 is a general block diagram schematic illustration of an embodiment of a hydrometallurgical method to recover metals from deoiled spent catalyst according to the invention.
Figure 3:
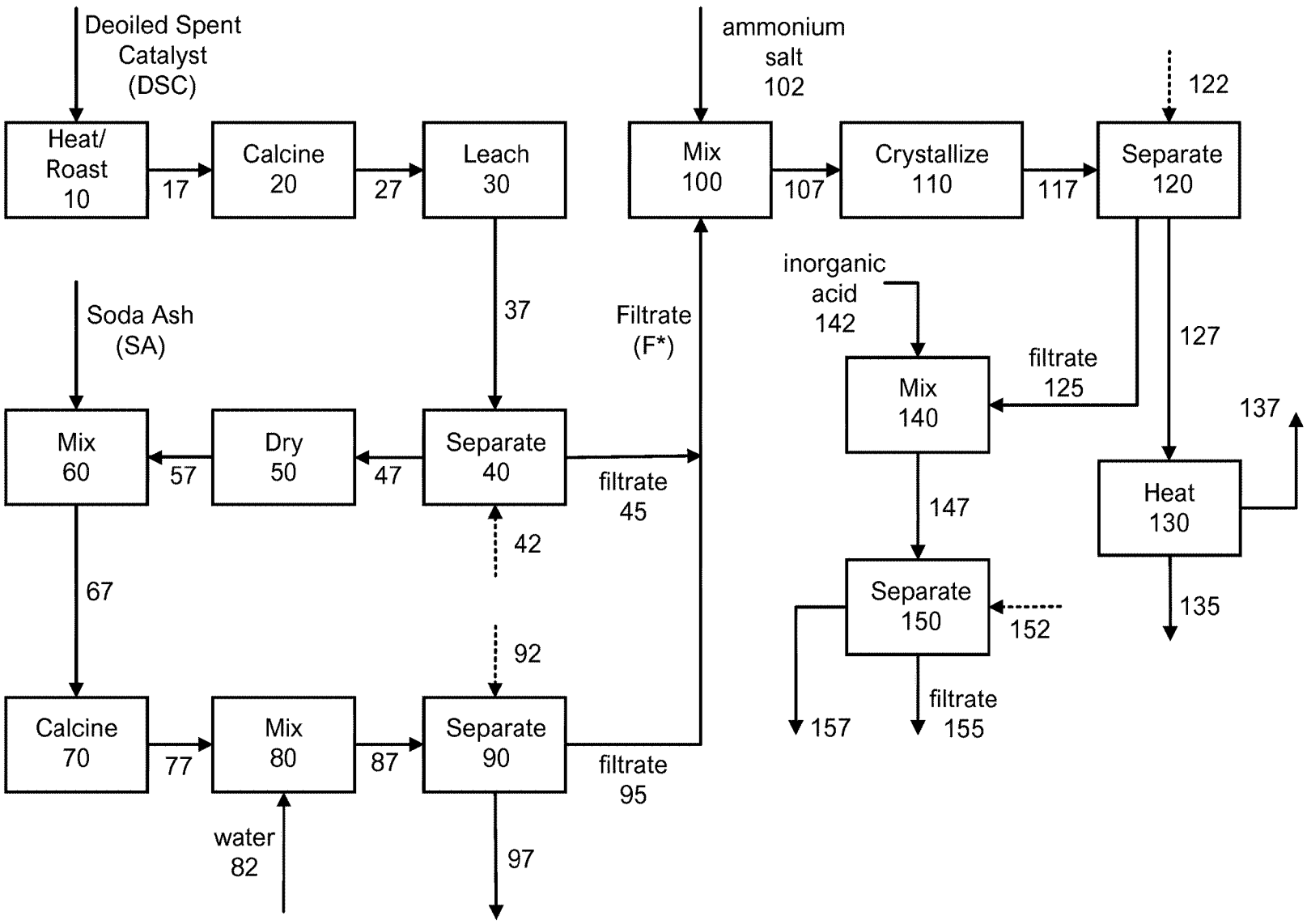
FIG. 3 is a general block diagram schematic illustration of an embodiment of a combined pyrometallurgical/hydrometallurgical method to recover metals from deoiled spent catalyst according to the invention.

An illustration of a hydrometallurgical method or process according to an embodiment of the invention is shown schematically in FIG. 2. Filtrate (F*) from one or more sources, e.g., spent catalyst filtrate streams 45 and 95 from the pyrometallurgical method shown in FIG. 1, comprising a Group VIB metal compound and Group VB metal compound aqueous mixture is mixed 100 with an ammonium salt 102 under metathesis reaction conditions to convert the metal compounds to ammonium Group VB metal and ammonium Group VIB metal compounds. The metathesis reaction mixture is subsequently subjected to crystallization conditions 107, 110 effective to crystallize the ammonium Group VB metal compound. The crystallized ammonium Group VB metal compound is subsequently passed 117 for separation 120 and recovery of the ammonium Group VB metal compound and an ammonium Group VIB metal compound filtrate. A saturated ammonium Group VB metal compound wash solution 122 at a pre-selected wash temperature may be used as necessary for filtering and washing of the ammonium Group VB metal compound crystals. The ammonium Group VB metal compound is subsequently passed 127 to for heating 130 and ammonia removal under conditions effective to release ammonia and for separately recovering the Group VB metal compound 135 and ammonia 137. The ammonium Group VIB metal compound filtrate from the separation step 120 is subsequently passed for mixing 140 with an inorganic acid 142 under conditions effective to form mixture of a Group VIB metal oxide compound precipitate and an ammonium salt of the inorganic acid. The mixture of the precipitate and salt are subsequently passed 147 for separation 150 of the Group VIB metal oxide compound precipitate and recovering the Group VIB metal oxide compound precipitate 157. A saturated ammonium Group VIB metal oxide compound wash solution 152 at a pre-selected wash temperature may be used as necessary for filtering and washing of the Group VIB metal oxide compound precipitate. The filtrate 155 from separation 150 may be subsequently subjected to further metals recovery steps as necessary, e.g., through ionic resin exchange steps, optionally with ammonia recovery/recycle.

Mixing of the filtrate (F*) with the ammonium salt is typically conducted under conditions that are effective to convert the Group VIB and Group VB metal compounds ammonium Group VB metal and ammonium Group VIB metal compounds. Seed crystals such as ammonium metavanadate (AMV) may be used, typically in a concentration of about 2000-8000 ppm, or 4000-6000 ppm, or about 5000 ppm. Typically, the pH range is less than about 8 when AMV seed is introduced. Although the skilled artisan may readily determine suitable methods to conduct the metathesis reaction, one useful procedure is to first reduce the pH to about 9 using nitric acid, followed by the introduction of ammonium nitrate and the introduction of AMV seed at a pH of less than about 8, preferably 8 or less, or in the range of 7.5 to 8.5, or 7.5 to 8.

During the mixing and metathesis reactions of the filtrate (F*), e.g., when the filtrate is derived from a spent catalyst comprising, e.g., Mo, Ni, V, Fe, C, and S, the following representative reactions are believed to form soluble (Mo) and insoluble (V) metal compounds:

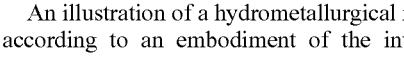

$$NH_4NO_3+NaVO_3 \rightarrow NH_4VO_{3\downarrow}+Na\ NO_3$$

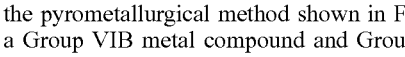

$$NH_4NO_3+Na_2MoO_4 \rightarrow (NH_4)_2MoO_4+2NaNO_3$$

The crystallization conditions, e.g., when ammonium metavanadate (AMV) crystals are to be produced, typically involve reduced temperature and pressure, e.g., a temperature of about 10° C. under a vacuum of about 21 in. Hg may be used. The skilled artisan will appreciate that different temperature and pressure (vacuum) conditions and crystallization times may be used. In general, a temperature in the range of greater than 0° C. to about 15° C., or greater than 0° C. to about 10° C., vacuum conditions, and a crystallization time period of about 1 hr to about 6 hr, or about 1 hr to about 4 hr, or about 1 hr to about 3 hr are useful. Filtration and washing of the crystals with reduced a temperature wash solution, e.g., an AMV wash solution of about 5000 ppm at about 10° C. may be used. Multiple washes of about 2-5 times, or about 3 times along with recycling of the wash solution to the crystallization step may be used as well. Typically, a wash temperature in the range of greater than 0° C. to about 15° C., or greater than 0° C. to about 10° C., or a wash solution temperature of about 10° C., have been found to be suitable, preferably wherein the crystallized ammonium Group VB metal compound and the wash solution comprise ammonium metavanadate and, optionally, wherein the wash solution is recycled for crystallization of the ammonium Group VB metal compound.

The ammonium Group VB metal compound may be subsequently heated at a temperature in the range of about 200-450° C., or 300-450° C., or 350-425° C., or about 375-425° C. for a time sufficient to release ammonia in an amount of at least about 90%, or 95%, or 98%, or 99% of the amount present in the ammonium Group VB metal compound. The Group VB metal compound may be subsequently further treated, e.g., in a furnace to produce Group VB metal compound flake. The overall recovery of the Group VB metal present in the aqueous mixture comprising the Group VIB and Group VB metal compounds may be greater than about 90 wt. %, or about 95 wt. %, or about 97 wt. %, or about 98 wt. %, or about 99 wt. %.

The acidulation conditions for contacting of the ammonium Group VIB metal compound filtrate with an inorganic acid comprise introducing the inorganic acid at a temperature in the range of about 50-80° C., or 50-70° C., or 55-70° C. to provide a pH of about 1-3, or about 1-2, or about 1, preferably wherein the inorganic acid comprises nitric acid or sulfuric acid, or is nitric acid.

During the acidulation reactions, e.g., when the filtrate is derived from a spent catalyst comprising, e.g., Mo, Ni, V, Fe, C, and S, the following representative reaction is believed to form insoluble (Mo) metal compound:

$$(NH_4)_2MoO_4+2HNO_3+H_2O \rightarrow MoO_3 \cdot 2H_2O_{\downarrow}+2NH_4NO_3$$

Following the acidulation reaction, a separation of the liquid and solid may be conducted using filtration and washing. The conditions for filtering and washing of the Group VIB metal oxide compound precipitate may be conducted, e.g., with a saturated ammonium Group VIB metal oxide compound wash solution at a wash temperature in the range of greater than 0° C. to about 15° C., or greater than 0° C. to about 10° C., or a wash solution temperature of about 10° C. Typically, when the spent catalyst comprises Mo as the Group VIB metal, the wash solution comprises ammonium heptamolybdate. As with all wash steps, the wash solution may be optionally recycled for filtering and washing, e.g., of the Group VIB metal oxide compound.

The overall recovery of the Group VIB metal present in the aqueous mixture comprising the Group VIB and Group VB metal compounds may be greater than about 90 wt. %, or about 95 wt. %, or about 97 wt. %, or about 98 wt. %, or about 99 wt. %.

The present pyrometallurgical and hydrometallurgical methods further allow for the exclusion of, or avoid the use of, certain compounds used in other pyrometallurgical and/or hydrometallurgical methods, including, e.g., Group IIA compounds, such as calcium compounds, or more particularly, calcium carbonate (e.g., as described in U.S. Pat. No. 8,057,763 B2 and other patents and methods that utilize calcium carbonate).

EXAMPLES

The following examples illustrate the recovery of Group VB and Group VIB metal compounds from deoiled spent slurry (unsupported) catalyst. The examples are provided for representative purposes only and should not be considered to limit the scope of the invention.

Example 1-A—Roasting Spent Catalyst (As-Is)

Controlled batch oxidation of 1,750-g de-oiled spent slurry catalyst comprising Mo and V compounds was carried out under $O_2$ starved conditions in a 7" diameter×29" operating length rotary quartz tube furnace, simulating multiple hearth furnace conditions, with retention times of up-to 8-hrs generated a calcine containing <0.1-wt % S & C respectively. The run began with a fast ramp-up to 500° C. under Argon gas flow to remove residual hydrocarbons in the spent catalyst. This was followed by a slow ramp to the operating bed temperature of 620° C. under reduced air flow, an extended hold period with $CO_2$ and $SO_x$ emission measurements, followed by a slow cool down under $O_2$ gas flow during reaction termination. The staged temperature control was used to avoid significant heat release that would result in Mo loss and solids sintering. A weight loss of ~57% (Table 9) was observed in a low-V calcine that corresponded to near complete S & C removal (<0.1-wt %) and conversion of metal sulfides to metal oxides. Tables 1 & 2 illustrate metal assays on feed and calcine. The term "Lo-V" was used to refer to the comparatively low vanadium content of the spent catalyst sample used (e.g., 0.94 wt. %), as compared with a "Hi-V" sample having a greater vanadium content (e.g., 4.74 wt. %).

TABLE 1

ROASTER SPENT CATALYST FEED AVERAGE ASSAYS (wt %)

| Type | Mo | Ni | V | Fe | C | H | S |
|---|---|---|---|---|---|---|---|
| Lo-V | 25.10 | 3.20 | 0.94 | 0.10 | 43.80 | 2.20 | 22.50 |

TABLE 2

ROASTER SPENT CATALYST CALCINE AVERAGE ASSAYS (wt %)

| Type | Mo | Ni | V | Fe | C | S |
|---|---|---|---|---|---|---|
| Lo-V | 58.24 | 7.47 | 2.18 | 0.23 | 0.02 | 0.07 |

Reactions (1) through (6) shown below represent combustion reactions believed to occur during spent catalyst roasting. The Gibb's free energies at 600° C. imply oxidation per the sequence V>Mo>Fe>Ni and free energies at 600° C. for $CO_2$ and $SO_2$ imply that C will combust at a faster rate than S.

| | | |
|---|---|---|
| $MoS_2 + 7/2O_2 = MoO_3 + 2SO_2\uparrow$ | $\Delta G_{873° K.} = -879$ kJ/g · mol | (1) |
| $NiS + 3/2O_2 = NiO + 2SO_2\uparrow$ | $\Delta G_{873° K.} = -375$ kJ/g · mol | (2) |
| $V_2S_3 + 11/2O_2 = V_2O_5 + 3SO_2\uparrow$ | $\Delta G_{873° K.} = -1{,}585$ kJ/g · mol | (3) |
| $2FeS + 7/2O_2 = Fe_2O_3 + 2SO_2\uparrow$ | $\Delta G_{873° K.} = -484$ kJ/g · mol | (4) |
| $C + O_2 = CO_2\uparrow$ | $\Delta G_{873° K.} = -396$ kJ/g · mol | (5) |
| $S + O_2 = SO_2\uparrow$ | $\Delta G_{873° K.} = -298$ kJ/g · mol | (6) |

Due to the unsupported, high surface area characteristics of the deoiled material and the absence of alumina and/or silica, reaction 7 below depicts nickel present in the feedstock securing onto molybdenum during the combustion reactions at ~620° C. to form an un-leachable refractory $NiMoO_4$ spinel phase. This component was detected by both XRD & QEMSCAN (Quantitative Evaluation of Materials by Scanning Electron Microscopy).

$$MoO_3+NiO=NiMoO_4 \quad \Delta G_{873° K}=-20 \text{ kJ/g·mol} \tag{7}$$

Another phase that could not be detected by XRD but was revealed by QEMSCAN included a mixed metal oxide of the form $(Mo_aNi_bV_c)O_d$. The V constituent in the mixed metal oxide was un-leachable in both caustic and acid environments.

Example 1B—Calcine Leaching with Caustic (NaOH)

Caustic leaching of the low-V calcine at 75° C., 15-wt % solids, pH 10.0 to 10.5 and retention times of 2.25-hrs yielded up-to 83% Mo & 83% V extractions (Table 3). Ni remained in the residue phase as $NiMoO_4$ (Table 4). Up-to 73% dissolution (Table 9) of the Lo-V calcine mass in caustic was observed with the remaining mass constituting spinel in the washed leach residue.

XRD scans on the leach residue verified the spinel structure as $\alpha$-$NiMoO_4$. The refractory V component could not be identified.

TABLE 3

CAUSTIC LEACH, KINETIC PERIOD EXTRACTIONS

| Time (min) | 45 | 90 | 135 | 45 | 90 | 135 |
|---|---|---|---|---|---|---|
| Lo-Vanadium (Lo-V) Spent Cat Calcine | Mo (%) | | | V(%) | | |
| | 78.7 | 79.1 | 81.6 | 81.5 | 82.2 | 82.4 |

TABLE 4

CAUSTIC LEACH RESIDUE AVERAGE ASSAYS (wt %)

| Type | Mo | Ni | V | Fe |
|---|---|---|---|---|
| Lo-V | 39.62 | 27.33 | 1.03 | 0.69 |

Example 1C—Caustic Leach Residue Calcination with Soda Ash

The low Mo and V extractions obtained from caustic leaching of roasted spent catalyst suggested that commercial metal recovery and project economics would not be attractive. Further investigations, however, revealed that nickel molybdate spinel reaction with soda ash at ~600° C. would transform the refractory Mo salt into a soluble version. The conversion may be represented by reaction 8:

$$NiMoO_4+Na_2CO_3=Na_2MoO_4+NiO+CO_2\uparrow \quad \Delta G_{873°K}: -96\ kJ/g{\cdot}mol \tag{8}$$

100-g of the dried caustic leach residue (spinel) was blended with anhydrous soda ash ($Na_2CO_3$, $P_{80}$ 100 μm) at up to 30% above the stoichiometric Mo and V content in the calcine, followed by calcination in a 4" diameter×14" operating length rotary quartz tube furnace under continuous flush with air at between 600° C. & 625° C. for 1.5-hrs. The run began with a fast ramp-up to 500° C. followed by a slow ramp-up to the operating bed temperature of up-to 625° C., a hold period of 1.5-hrs, followed by a slow cool down during reaction termination. The temperature processing sequence was used to help avoid solids fusibility and sintering. Table 5 portrays metal assays in the calcine. A weight gain of ~43% (Table 9) was observed in the Lo-V calcine that appeared to indicate near complete breaching of the spinel into water soluble molybdate and vanadate.

TABLE 5

SODA ASH CALCINED SPINEL AVG ASSAYS TO HOT WATER LEACH, WT AVG ASSAYS (wt %)

| Type | Mo | Ni | V | Fe | Al | Na | C* | S |
|---|---|---|---|---|---|---|---|---|
| Lo-V | 26.93 | 18.07 | 0.74 | 0.41 | 0.05 | 16.14 | 1.17 | <0.2% |

note:

*C from excess $Na_2CO_3$

Example 1D—Soda Ash Calcine Hot Water Leaching

The soda ash calcine was leached in hot water at 75° C. (pH 10.5-11.0) at 15-wt % solids for 1.5-hr without pH modification of the sample. The leach residue was vacuum filtered, washed, dried and analyzed for metals content. The leach solution was set aside to be evaluated for hydrometallurgical separation of V from Mo.

Mo and V extractions up-to 95% and 70% respectively (Table 6) were achieved from hot water leaching of the Lo-V soda ash calcine for overall pyrometallurgical Mo and V extractions of up to 99% and 95% respectively from the spent catalyst. A weight loss of up to 71% was apparent (Table 9). Leach residue metal assays are represented in Table 7, which shows Ni as constituting up to ⅔ of the unreacted solids phase.

TABLE 6

HOT WATER LEACH, KINETIC PERIOD EXTRACTIONS

| | Time (min) | | | |
|---|---|---|---|---|
| | 45 | 90 | 45 | 90 |
| Lo-Vanadium (Lo-V) Soda ash Calcine | Mo (%) | | V(%) | |
| | 86.8 | 95.2 | 64.7 | 69.7 |

TABLE 7

HOT WATER LO-V SPENT CATALYST LEACH RESIDUE, AVERAGE ASSAYS (wt %)

| Mo | Ni | V | Fe | Ca | Na | Al | Co | Cr | Cu | Mg | Mn | Zn |
|---|---|---|---|---|---|---|---|---|---|---|---|---|
| 4.36 | 65.75 | 0.85 | 1.50 | 0.18 | 0.47 | 0.16 | 0.025 | 0.076 | 0.040 | 0.054 | 0.018 | 0.040 |

Example 1E—Overall Mass Balance of Examples 1A Through 1D

Table 8 indicates less than 5-wt % of a high Ni residual persisted following the listed sequence of unit operations on the original Lo-V spent catalyst.

TABLE 8

LO-V SPENT CATALYST MASS LOSS AT PROCESS STEPS

| Spent Cat | Calcine | Leach Residue | Calcined Spinel* | Final Ni Residue |
|---|---|---|---|---|
| 100.00 g | 43.00 g | 11.61 g | 16.60 g | 4.81 g |

note:

*Includes ~30% of additional soda ash above stoichiometric Mo and V content

Table 9 illustrates the progression of metals removal, or absence of metals depletion thereof, during the process stages, beginning from the spent catalyst feed and culminating in the insoluble Ni residue. Cumulative weight loss ("Cuml. Wt. Loss") for each step is shown. Mo and V pyrometallurgical metal extraction percentages ("Extrn (%)") are shown for each process step with the overall Mo extraction being 99.1% and the overall V extraction being 94.7%.

TABLE 9

METALS CONTENT AT PROCESS STEPS

| Lo-V Feed Process Step | Processed Wt (g) | Cuml. Wt Loss (%) | Mo (g) | Mo (wt. %) | Mo Extrn (%) | V (g) | V (wt. %) | V Extrn (%) | Ni (g) | Ni (wt. %) | Fe (g) | Fe (wt. %) |
|---|---|---|---|---|---|---|---|---|---|---|---|---|
| Spent Catalyst | 100.00 | 0.00 | 25.10 | 25.10 | 0.00 | 0.94 | 0.94 | 0.00 | 3.20 | 3.20 | 0.10 | 0.10 |
| Calcine | 43.00 | 57.00 | 25.10 | 58.37 | 0.00 | 0.94 | 2.19 | 0.00 | 3.20 | 7.44 | 0.10 | 0.23 |
| NaOH Leach Residue | 11.61 | 73.00 | 4.62 | 39.78 | 81.60 | 0.17 | 1.42 | 82.40 | 3.20 | 27.56 | 0.10 | 0.86 |
| Spinel + Soda Ash Calcination | 16.60 | 43.00 | 4.62 | 27.82 | 0.00 | 0.17 | 1.00 | 0.00 | 3.20 | 19.27 | 0.10 | 0.60 |
| Ni Residue | 4.81 | 71.00 | 0.22 | 4.62 | 95.18 | 0.05 | 1.04 | 69.73 | 3.20 | 66.46 | 0.10 | 2.08 |
| Overall pyronnetallurgical metal extraction: | | | | | 99.1% | | | 94.7% | | | | |

Example 1F—Ammonium Metavanadate (AMV) Crystallization from Caustic Leach Pregnant Solution A stirred solution of the leach filtrate (pH 10.5 and above) was heated to 60° C., with sufficient 70% concentrated $HNO_3$ acid added to lower the pH to ~8.8. 100-gpL $NH_4NO_3$ crystals were added and the pH was adjusted to ~7.5 with $HNO_3$ or $NH_4OH$. Note: for a solution vanadium concentration of <10-gpL, an ammonium metavanadate (AMV) seed/spike of 10-gpL is added in powder form to the hot stirred solution. The metathesis reaction was continued for 1.5-hour at 60° C. with the pH maintained between 7.0 and 8.0.

The following double displacements constitute the metathesis or ion exchange between $NH_4^+$ and $Na^+$ depicted in reactions 9 and 10:

$$NH_4NO_3+NaVO_3=NH_4VO_3\downarrow+Na\ NO_3 \quad (9)$$

$$2NH_4NO_3+Na_2MoO_4=(NH_4)_2MoO_4+2NaNO_3 \quad (10)$$

The solution was subsequently transferred to a vacuum cooling crystallizer at 10° C. under 21-inch Hg for 3-hrs with crystallization continued under gentle rotation. The AMV crystals were vacuum filtered with the filtrate set aside for Mo precipitation. The crystals were washed with three volumes of pure 4,800-mg/L AMV solution chilled to 10° C. The wash solution was considered suitable for reuse until the residual Mo concentration augments of up to 25,000-ppmw were reached, after which it would be recycled to the metathesis circuit. The yellowish AMV crystals were dried at 60° C.-70° C. Table 10 shows that continuous cooling crystallization at 10° C. lowers the V content in the barren solution. Note that the estimated AMV purity includes up-to 97-wt % $NH_4VO_3$, with the remainder as Mo and Na species together with $NO_3^-$ anions. The barren solution or Mo filtrate was transferred to the acid precipitation circuit for Mo recovery.

TABLE 10

Ammonium Metavanadate (AMV) Crystallization from Caustic Leach

| Sample ID | Solution Chemistry | AMV Crystallization Heating | Time (min) | Cooling | Time (min) | AMV Solids (Wt. %) Mo | AMV Solids (Wt. %) V | Barren Solution (Wt. %) Mo | Barren Solution (Wt. %) V | AMV Recovery (%) |
|---|---|---|---|---|---|---|---|---|---|---|
| A | Nitrate | 30° C. | 60 | 10° C. | 90 | 0.877 | 41.7 | 6.93 | 0.060 | 91 |
| B | Nitrate | Cooling at 10° C. only | | 10° C. | 180 | 0.388 | 42.0 | 6.89 | 0.033 | 95 |

Example 1G—Molybdenum Trioxide Precipitation from AMV Barren Solution

The stirred barren solution from the V crystallization circuit was heated to 65° C. followed by careful addition of 70% concentrated $HNO_3$ acid to provide a pH ~1.0. The pH and temperature were maintained with adequate stirring for 2.5-hours. Table 11 depicts up to 99% Mo recovery within 2-hours at the lower pH and temperature and higher $HNO_3$ acid dosage. The slurry was cooled to near ambient at reaction termination and prior to filtration. The barren filtrate containing <1,000-mg/L Mo & <100 mg/L V was suitable for transfer to Ion-Exchange for residual metals removal. The cake was washed with 2 volumes (PV) pH 1 ambient ammonium heptamolybdate (AHM)* with the wash filtrate recycled. The cake solids were subsequently re-slurried at 25 wt % solids in pH 1 AHM at ambient w/stirring for 15-min. The slurry was re-filtered with exiting barren filtrate to wash recycle. The filter cake was washed with 4 volumes of pH 1 ambient AHM. The barren filtrate was recycled as wash. Solids were dried at 70° C. to 100° C. The estimated $MoO_3$ purity includes up-to 95-wt % $MoO_3.H_2O$, up-to 0.75-wt % total Na and V and the remaining $NH_4^+$ and $NO_3^-$ ions. The described sequence of wash steps was used to lower $Na^+$ ion levels to <0.5-wt % in the $MoO_3$ product, since the alkali metal acts as a poison during catalyst synthesis so reduced values are desired. $Na^+$ ion levels in the $MoO_3$ slurry may run up to 10% with an immobile and unremovable fraction of the $Na^+$ ion substituting hydronium ions in the layered $MoO_3$ structure.

*pH 1 AHM is prepared by acidulating pure 200-gpL ammonium heptamolybdate (AHM) solution to pH 1 at 65° C. for 2.5-hrs with conc. $HNO_3$ acid. Following liquid-solid separation, the $MoO_3$ solids may be recovered as final product and the filtrate used as wash solution for the commercial $MoO_3$ cake.

TABLE 11

Molybdenum Trioxide precipitation from AMV Barren Solution

| Sample ID | Conditions | Time | Wt % Solids | Mo rec | V rec |
|---|---|---|---|---|---|
| A1 | 65 C, pH: 1, conc $HNO_3$ | 60 | 12.2% | 92.8% | 62.9% |
| | added: 90-kg/mt solution | 120 | 12.4% | 99.0% | 79.7% |
| | | 240 | 13.3% | 99.1% | 84.3% |
| A2 | 75 C, pH ~1, conc $HNO_3$ | 60 | 12.5% | 91.3% | 44.2% |
| | added: 90-kg/mt solution | 120 | 14.2% | 98.6% | 83.1% |
| | | 180 | 13.3% | 99.1% | 86.0% |
| A3 | 75 C, pH ~1.6, conc $HNO_3$ | 60 | 16.6% | 93.8% | 20.7% |
| | added: 70-kg/mt solution | 120 | 17.7% | 98.8% | 25.5% |
| | | 240 | 19.7% | 99.1% | 28.8% |

As shown, pyrometallurgical extractions of up to 99% Mo and up to 95% V coupled with hydrometallurgical recoveries of up to 99% Mo and up to 95% V provide metal recoveries of 98% Mo & 90% V.

Example 2-A—Roasting Spent Catalyst (As-Is)

Controlled batch oxidation of 1,750-g de-oiled spent slurry catalyst comprising Mo and V compounds was carried out under $O_2$ starved conditions in a 7" diameter×29" operating length rotary quartz tube furnace, simulating multiple hearth furnace conditions, with retention times of up-to 8-hrs generated a calcine containing <0.1-wt % S & C respectively. The run began with a fast ramp-up to 500° C. under Argon gas flow to remove residual hydrocarbons in the spent catalyst. This was followed by a slow ramp to the operating bed temperature of 620° C. under reduced air flow, an extended hold period with $CO_2$ and $SO_x$ emission measurements, followed by a slow cool down under $O_2$ gas flow during reaction termination. The staged temperature control was used to avoid significant heat release that would result in Mo loss and solids sintering. A weight loss of ~57% (Table 9) was observed in a low-V calcine that corresponded to near complete S and C removal (<0.1-wt %) and conversion of metal sulfides to metal oxides. Tables 1 and 2 from above illustrate metal assays on roaster feed and calcine. Reactions (1) through (6) above represent combustion reactions. Gibb's free energies at 600° C. imply oxidation per the sequence V>Mo>Fe>Ni and free energies at 600° C. for $CO_2$ and $SO_2$ imply that C will combust at a faster rate than S.

Due to the unsupported, high surface area characteristics of the deoiled spent catalyst material and the absence of alumina and/or silica, reaction 7 from above depicts nickel present in the feedstock latching onto molybdenum during the combustion reactions at ~620° C. to form an un-leachable refractory $NiMoO_4$ spinel phase.

Example 2B—Roasted Product Calcination with Soda Ash

Reactions (1) and (3) through (6) below represent soda ash reactions with the roaster product during calcination. Gibb's free energies at 600° C. imply the favorability of the spinel phases breached with soda ash under these conditions:

| | | |
|---|---|---|
| $MoO_3 + NiO = NiMoO_4$ | $\Delta G_{873°\,K} = -20$ kJ/g.mol | (1) |
| $NiMoO_4 + Na_2CO_3 = Na_2MoO_4 + NiO + CO_2\uparrow$ | $\Delta G_{873°\,K} = -96$ kJ/g.mol | (3) |
| $2FeVO_4 + Na_2CO_3 = 2NaVO_3 + Fe_2O_3 + CO_2\uparrow$ | $\Delta G_{873°\,K} = -86$ kJ/g.mol | (4) |
| $MoO_3 + Na_2CO_3 = Na_2MoO_4 + CO_2\uparrow$ | $\Delta G_{873°\,K} = -116$ kJ/g.mol | (5) |
| $V_2O_5 + Na_2CO_3 = 2NaVO_3 + CO_2\uparrow$ | $\Delta G_{873°\,K} = -156$ kJ/g.mol | (6) |

The roasted material (calcine) was blended with soda ash at 30% above the stoichiometric Mo and V content in the calcine. The run began in a 4" diameter×14" operating length quartz kiln with a fast ramp-up to 500° C. under air flow followed by a slow ramp to the operating bed temperature of 620° C. under reduced air flow. A hold period of 2-hrs was sufficient to lower $CO_2$ emissions to <0.1-wt %. This was followed by a slow cool down to 100° C. under air flow prior to removing the kiln solids. Approximately 75% of the material was fused to the rotary quartz kiln wall with portions of the tube etched off silica due to the corrosive nature of the alkali under the operating conditions. Frequent operational shut-down of the commercial indirect fired rotary calciner was necessary to free the unit of tacky calcine build-up. Although high Mo and V metal extractions of >95% were obtained from hot water leaching of the soda ash calcine (i.e., the portion that could be ultimately recovered from the rotary kiln), the approach was considered to be commercially impractical.

Example 3-A—Roasting with Soda Ash

Reactions (1) through (7) below represent metal oxidation reactions with soda ash. Gibb's free energies at 600° C. imply favorable oxidation according to the sequence V>Mo>Fe>Ni>C>S, while free energies at 600° C. for $CO_2$ and $SO_2$ imply that C will combust at a faster rate than S.

| | | |
|---|---|---|
| $MoS_2 + 3Na_2CO_3 + 9/2O_2 = Na_2MoO_4 + 2Na_2SO_4 + 3CO_2\uparrow$ | $\Delta G_{873°\,K} = -1{,}504$ kJ/g.mol | (1) |
| $V_2S_3 + 4Na_2CO_3 + 7O_2 = 2NaVO_3 + 3Na_2SO_4 + 4CO_2\uparrow$ | $\Delta G_{873°\,K} = -2{,}506$ kJ/g.mol | (2) |
| $NiS + Na_2CO_3 + 2O_2 = NiO + Na_2SO_4 + CO_2\uparrow$ | $\Delta G_{873°\,K} = -630$ kJ/g.mol | (3) |
| $2FeS + 2Na_2CO_3 + 9/2O_2 = Fe_2O_3 + 2Na_2SO_4 + 2CO_2\uparrow$ | $\Delta G_{873°\,K} = -739$ kJ/g.mol | (4) |
| $C + O_2 = CO_2\uparrow$ | $\Delta G_{873°\,K} = -396$ kJ/g.mol | (5) |
| $S + O_2 = SO_2\uparrow$ | $\Delta G_{873°\,K} = -298$ kJ/g.mol | (6) |
| $Na_2CO_3 + SO_2 + 1/2O_2 = Na_2SO_4 + CO_2\uparrow$ | $\Delta G_{873°\,K} = -255$ kJ/g.mol | (7) |

Controlled batch oxidation of 100-g of de-oiled spent slurry catalyst comprising Mo and V compounds with soda ash was carried out under $O_2$ starved conditions in a 4" diameter×14" operating length rotary quartz tube furnace, simulating multiple hearth furnace conditions, with retention times of up-to 2.5-hrs generated a calcine containing ~0.1-wt % S & <0.5-wt % C respectively. The spent catalyst was thoroughly blended with anhydrous soda ash ($P_{80}$ 100 μm) at 30% above the stoichiometric Mo & V content in the calcine. The run began with a fast ramp-up to 500° C. under Argon gas flow to remove residual hydrocarbons in the spent catalyst followed by a slow ramp to the operating bed temperature of 600° C. under reduced air flow, an extended hold period with $CO_2$ and $SO_x$ emission measurements, followed by a slow cool down under $O_2$ gas flow during reaction termination. Minimal $SO_x$ evolution was evident indicating conversion of the sulfides directly to sulfate. Clinker and sticky solids were apparent following cool down with significant adherence to the quartz wall of the tubular reactor. This phenomenon would result in weekly or more frequent shut-down of the commercial multiple hearth furnace to clean hearths and rabble arms of the tacky calcine build-up. Although Mo and V extractions of >98% & >86% respectively were achieved from hot water leaching of the Lo-V soda ash calcine (i.e., the portion that could be ultimately recovered from the rotary furnace), the approach was considered to be commercially impractical.

Additional details concerning the scope of the invention and disclosure may be determined from the appended claims.

The foregoing description of one or more embodiments of the invention is primarily for illustrative purposes, it being recognized that variations might be used which would still incorporate the essence of the invention. Reference should be made to the following claims in determining the scope of the invention.

For the purposes of U.S. patent practice, and in other patent offices where permitted, all patents and publications cited in the foregoing description of the invention are incorporated herein by reference to the extent that any information contained therein is consistent with and/or supplements the foregoing disclosure.

What is claimed is:

1. A method for recovering metals from a deoiled spent catalyst, the method comprising:

heating a deoiled spent catalyst comprising a Group VIB metal, a Group Vill metal, and a Group VB metal under oxidative conditions at a first pre-selected temperature for a first time sufficient to reduce the levels of sulfur and carbon to less than pre-selected amounts and to form a calcined spent catalyst;

contacting the calcined spent catalyst with a caustic leach solution to form a spent catalyst slurry at a pre-selected leach temperature for a pre-selected leach time and at a pre-selected leach pH;

separating and removing a first filtrate and a first solid residue from the spent catalyst slurry, the first filtrate comprising a soluble Group VIB metal compound and a soluble Group VB metal compound and the first solid residue comprising an insoluble Group VIII/Group VIB/Group VB metal compound;

drying the insoluble Group VIII/Group VIB/Group VB metal compound first solid residue;

combining the dried Group VIII/Group VIB/Group VB metal compound first solid residue with anhydrous soda ash to form a solid residue/soda ash mixture;

heating the metal compound solid residue/soda ash mixture at a second pre-selected temperature and for a second pre-selected time under gas flow conditions to form a soda ash calcine;

contacting the soda ash calcine with water to form a soda ash calcine slurry at a temperature and for a time sufficient to leach a soluble Group VIB metal compound and a soluble Group VB metal compound from the soda ash calcine;

separating and removing a second filtrate and a second solid residue from the soda ash calcine slurry, the second filtrate comprising the soluble Group VIB metal compound and the soluble Group VB metal compound and the second solid residue comprising an insoluble Group VIII metal compound; and recovering the soluble Group VIB metal compound and the soluble Group VB metal compound from the spent catalyst slurry first filtrate and from the soda ash calcine slurry second filtrate;

wherein, the oxidative heating conditions comprise heating the deoiled spent catalyst at the first pre-selected temperature in the presence of air, or a gas mixture comprising no more than about 20 vol. % oxygen followed by heating the deoiled spent catalyst at the first pre-selected temperature under gas conditions comprising more than about 80 vol. % oxygen; or, wherein the gas flow conditions comprise an inert gas and are sufficient to remove any off-gases.

2. The method of claim 1, wherein the deoiled spent catalyst is substantially devoid of residual hydrocarbons, or is devoid of residual hydrocarbons, or comprises residual hydrocarbons in an amount of less than about 1000 ppm.

3. The method of claim 1, wherein the deoiled spent catalyst comprises residual hydrocarbons and the process further comprises heating the catalyst under non-oxidative conditions at a pre-selected non-oxidative condition temperature for a time sufficient to reduce the level of residual hydrocarbons to an amount of less than about 1000 ppm.

4. The method of claim 3, wherein the pre-selected non-oxidative condition temperature is in the range of about 350° C. to 500° C.

5. The method of claim 1, wherein the deoiled spent catalyst is substantially devoid of catalyst support materials comprising alumina, silica, titania, or a combination thereof, or wherein a catalyst support material comprising alumina, silica, titania, or a combination thereof is not used to prepare the catalyst.

6. The method of claim 1, wherein the spent catalyst comprises or is a slurry catalyst.

7. The method of claim 1, wherein the oxidative heating conditions comprise heating in the presence of an inert gas, air, or a combination thereof.

8. The method of claim 1, wherein the oxidative heating conditions comprise heating the deoiled spent catalyst at the first pre-selected temperature in the presence of air, or a gas mixture comprising no more than about 20 vol. % oxygen.

9. The method of claim 8, wherein the oxidative heating conditions further comprise heating the deoiled spent catalyst at the first pre-selected temperature under gas conditions comprising more than about 80 vol. % oxygen.

10. The method of claim 1, wherein the first pre-selected temperature is greater than about 600° C.

11. The method of claim 1, wherein the levels of sulfur and carbon are individually or both reduced to less than pre-selected amounts, as measured by $CO_2$ and $SO_2$ off-gas analysis, of less than about 1 wt. %.

12. The method of claim 1, wherein the pre-selected leach temperature is greater than about 60° C.

13. The method of claim 1, wherein the pre-selected leach time is in the range of about 1-5 hr.

14. The method of claim 1, wherein the pre-selected leach pH is in the range of about 9.5 to 11.

15. The method of claim 1, wherein the first filtrate comprises soluble molybdate or vanadate compounds, or a mixture thereof.

16. The method of claim 1, wherein the first filtrate contains greater than about 80 wt. % of the Group VIB metal or greater than about 85 wt. % of the Group VB metal present in the deoiled spent catalyst, or both greater than about 80 wt. % of the Group VIB metal and greater than about 85 wt. % of the Group VB metal present in the deoiled spent catalyst.

17. The method of claim 1, wherein the first solid residue is dried at a temperature in the range of about 110-140° C.-for a time period in the range of 0.5-2 hr.

18. The method of claim 1, wherein the first solid residue is dried at a temperature and for a time sufficient to reduce the amount of water to less than about 2 wt. %.

19. The method of claim 1, wherein the first solid residue comprises Group VB and/or Group VIB metal compound solids.

20. The method of claim 1, wherein the second pre-selected temperature is in the range of about 600° C. to 650° C.

21. The method of claim 1, wherein the second pre-selected time is in the range of about 0.5-2 hr.

22. The method of claim 1, wherein the soda ash calcine is contacted with water to form the soda ash calcine slurry at a temperature greater than about 60° C.

23. The method of claim 1, wherein the soda ash calcine leach time is in the range of 0.5-4 hr.

24. The method of claim 1, wherein the soda ash calcine leach is conducted without pH modification.

25. The method of claim 1, wherein the second filtrate comprises sodium molybdate, sodium vanadate, or a mixture thereof.

26. The method of claim 19, wherein the second filtrate contains the Group VB metal present in the Group VB and/or Group VIB metal compound in an amount greater than about 90 wt. %.

27. The method of claim 1, wherein the second filtrate contains the Group VIB metal present in the Group VB and/or Group VIB metal compound in an amount greater than about 90 wt. %.

28. The method of claim 1, wherein the overall extraction of the Group VB metal present in the deoiled spent catalyst is greater than about 90 wt. %.

29. The method of claim 1, wherein the overall extraction of the Group VIB metal present in the deoiled spent catalyst is greater than about 90 wt. %.

30. The method of claim 1, wherein a Group IIA compound is excluded from the method, or wherein a calcium compound is excluded from the method, or wherein calcium carbonate is excluded from the method.

* * * * *